US007125829B2

(12) United States Patent
Benincasa

(10) Patent No.: US 7,125,829 B2
(45) Date of Patent: Oct. 24, 2006

(54) SOLUTION FOR REMOVING MAGNESIUM CHLORIDE COMPOUND FROM A SURFACE CONTAMINATED THEREWITH

(76) Inventor: Dale Benincasa, 800 Pearl St., Suite 1206, Denver, CO (US) 80203

( * ) Notice: Subject to any disclaimer, the term of this patent is extended or adjusted under 35 U.S.C. 154(b) by 299 days.

(21) Appl. No.: 10/914,661

(22) Filed: Aug. 9, 2004

(65) Prior Publication Data

US 2006/0030502 A1 Feb. 9, 2006

(51) Int. Cl.
*C11D 3/20* (2006.01)

(52) U.S. Cl. ..... 510/241; 510/245; 510/258; 510/362

(58) Field of Classification Search ..... None
See application file for complete search history.

(56) References Cited

U.S. PATENT DOCUMENTS

| | | | | |
|---|---|---|---|---|
| 4,097,270 | A | 6/1978 | Rao et al. | |
| 4,386,005 | A * | 5/1983 | Kapiloff et al. | 252/180 |
| 4,496,470 | A * | 1/1985 | Kapiloff et al. | 510/162 |
| 4,806,259 | A * | 2/1989 | Amjad | 510/162 |
| 4,913,823 | A | 4/1990 | Lipinski et al. | |
| 5,196,146 | A * | 3/1993 | Farella et al. | 510/365 |
| 5,609,692 | A | 3/1997 | Johnson et al. | |
| 5,961,736 | A | 10/1999 | Borah et al. | |
| 6,544,342 | B1 | 4/2003 | O'Keefe et al. | |
| 6,670,312 | B1 | 12/2003 | Sugimoto et al. | |

OTHER PUBLICATIONS

Proctor, Cathy, "Dirty Truck Woes Remedied by Entrepreneurs' Solution", *Denver Business Journal*, (Jan. 22. 2002), 2pp.

Product Flier, "Got Corrosion? Road Grime & De-Icer Residue a Problem?", *Advantage Coatings & Cleaners* (*dealer: Interstate Turbo Supply*; www.interstateturbo.com), (20024),2pp.

Product Flier, "Material Safety Data Sheet for DYNA Clean Acid Cleaner & Presoak", *Universal Chemicals & Supplies, Inc., a division of Certol International LLC*, (Mar. 7, 2004), 2 pp.

Product Website, "About Global Specialty Chemicals", www.chemicals-globalspecialty.com, (2004),4 pp.

Public Meeting Minutes, "Meeting with Jim Andler re Magnesium Choloride on Roads", *Board of Montana Flathead County Commissioners Meeting*, (Feb. 24, 2003),22 pp.

Research Website, "Magnesium Choloride as a De-Icing Agent", *U.S. Dairy Association* (www.usda.gov/rus/electric/engineering), (2004),2 pp.

Research Website, "Winter Maintenance: Snow and Ice Removal", *University of Michigan Occupational Safety & Environmental Health*, (2004),7 pp.

Website Ecowash, Inc., "*Ultima Plus" vehicle wash and magnesium chloride remover*; 2004.

* cited by examiner

*Primary Examiner*—Gregory Webb
(74) *Attorney, Agent, or Firm*—Ian R. Walsworth

(57) ABSTRACT

A solution containing approximately 40–60% by weight phosphoric acid, approximately 1–6% by weight a surfactant, approximately 0.5–5% by weight an inhibitor, and the remaining percentage by weight made up of water for removing magnesium chloride from certain materials, namely aluminum, aluminum alloys, steel, rebar, chrome, plastics, ceramics, rubber, including insulation on electrical wiring, and painted surfaces including those previously mentioned. The solution may be applied in various ways, including through a low-pressure sprayer or similar device used in car and truck washing service areas. Alternatively, the solution may be applied as a mask or coating, and after a period of time rinsed away from the contaminated surface.

12 Claims, No Drawings

SOLUTION FOR REMOVING MAGNESIUM CHLORIDE COMPOUND FROM A SURFACE CONTAMINATED THEREWITH

BACKGROUND OF INVENTION

Magnesium chloride is a compound having the chemical abbreviation $MgCl^2$, and exists in its steady state as a liquid. It has a variety of different uses. One of these uses is as a de-icer or anti-icer. In this capacity it is applied as a brine solution directly to a surface to eliminate or prevent ice from forming by lowering the temperature at which the water freezes.

Magnesium chloride is increasingly being applied to roads, streets and highways during winter months to prevent dangerous driving conditions. The process of lowering the freezing point allows snow removal equipment such as snowplows to more effectively remove the soft, slushy material from the surface. It also has been found to be favorable in comparison to sand and salt mixtures which pollute the air and otherwise harm the environment.

As vehicles travel on these routes the magnesium chloride splashes off the surface of the road and deposits on the vehicle. During repeated travel over the winter months, the magnesium chloride continues to build up and can become as much as ½ inch thick in high exposure areas on the vehicle. Unlike other salts applied to the road, magnesium chloride does not dry out, and will retain water and continue to maintain solubility as long as the environment remains above twenty-seven percent (27%) humidity. Magnesium chloride in this state has a corrosive effect on several different types of metal, plastic, rubber, and other surfaces including painted surfaces of the type listed above. This corrosive effect includes deterioration to the strength and durability of the material, and often causes discoloration. In addition, magnesium chloride can deteriorate wiring insulation and cause serious damage to electrical systems. This level of buildup can deteriorate metal structural surfaces of the vehicle and cause electrical systems to malfunction, creating the potential for catastrophic failure for a vehicle traveling at highway speeds. Simply washing or spraying the vehicle with water or soap will not remove the magnesium chloride deposits.

Magnesium chloride contamination on barriers, signs, guardrails, power distribution equipment and other roadside structures is also a serious problem. As the compound is applied to the road surface it can splash onto these structures and cause corrosion. Vehicles traveling on the road, including street sweepers and snowplows may also cause magnesium chloride to become deposited on these structures. Furthermore, the magnesium chloride is able to penetrate the concrete surface of the road and contaminate the reinforcing steel or rebar members, thereby weakening structures such as overpasses, bridges and ramps.

Magnesium chloride contamination caused by pedestrian travel along these roads and subsequent tracking of magnesium chloride into buildings causes yet another problem. Metal decking and other metal floor surfaces may be damaged by the contamination of magnesium chloride. In order to prevent damage to the floor surface expensive cleaning measures must be taken.

Various solutions and methods for treating magnesium chloride deposits have been attempted during recent years. An early solution included a high percentage of hydrofluoric acid. However, this solution had the serious disadvantage of causing corrosion to the surface it was applied to, and to other surrounding surfaces including glass. Further renditions made to this solution reduced but never eliminated harmful environmental effects caused by the concentrated acid present in the solution. Other methods have since been introduced to eliminate these disadvantages.

One of these methods is disclosed in U.S. Pat. No. 5,609,692. This invention relies on a dilute aqueous solution to remove a chloride compound from a metallic, concrete, plastic or plastic laminate surface. One disadvantage of the system disclosed in U.S. Pat. No. 5,609,692 is the number of different agents that must be used in conjunction with the hydroxyacetic acid. These include sodium xylene sulfonate, triethanolamine, diethanolamine and stoichiometric soap. In addition, this invention does not disclose a method for inhibiting chloride compound build up on metallic surfaces in combination with the solution employed.

Other systems have tried to overcome these disadvantages. One such system is disclosed in U.S. Pat. No. 6,544,342. This invention discloses a method for controlling the level of acidity while removing contaminants from a metallic article. However, this method requires the use of an acid bath, which is impractical for use with a vehicle of any size. It is also impractical for use directly on roadside structures.

It is therefore desirable to provide a solution and method for applying the solution to these and other surfaces to remove magnesium chloride and inhibit further corrosion. It is furthermore desirable to provide a solution that is both easy to apply and less damaging to a number of different freestanding structures.

SUMMARY OF INVENTION

The present invention in a preferred embodiment solves these problems and others by providing a unique solution for removing magnesium chloride from certain materials, namely aluminum, aluminum alloys, steel, rebar, chrome, plastics, ceramics, rubber, including insulation on electrical wiring, and painted surfaces including those previously mentioned.

In this preferred embodiment of the invention, the solution includes approximately 40–60% by weight phosphoric acid, 1–6% by weight a wetting agent, 0.5–5% by weight an inhibitor, with the remaining percentage by weight made up of water.

This solution may be applied in various ways. In a preferred embodiment the solution is applied through a low-pressure sprayer or similar device used in car and truck washing service areas. The solution may be applied even before a single exposure to magnesium chloride as a preventative measure. In an alternative embodiment the solution may be applied as a mask or coating, and after a few minutes rinsed away from the contaminated surface.

These and other features of the present invention are evident from the detailed description of preferred embodiments. (For a fuller understanding of the nature and advantages of the invention, reference should be made to the ensuing detailed description taken in conjunction with the accompanying example.)

DETAILED DESCRIPTION

The present invention provides a solution for removing and inhibiting magnesium chloride deposits. Preferred embodiments of the present invention are described below. It is to be expressly understood that these exemplary embodiment are provided for descriptive purposes only and are not meant to unduly limit the scope of the present inventive concept. Other embodiments and variations of these embodiments are considered within the present inventive concept as set forth in the claims herein. For explanatory purposes only, the vehicle and roadside materials are discussed primarily for the purposes of understanding one potential application of the invention. It is to be expressly understood that other materials and types of surfaces are contemplated for use with the present invention as well.

As will be understood by those familiar with the art, the present invention may be embodied in other specific forms without departing from the spirit or essential characteristics thereof. For example, the present invention is not limited to magnesium chloride deposits caused by snow removal procedures. The solution may be applied to any surface of the type listed below that has been exposed to magnesium chloride. Accordingly, the disclosure of the preferred embodiment of the invention is intended to be illustrative, but not limiting, of the scope of the invention which is set forth in the following claims.

The present invention in a preferred embodiment provides a solution for removal and inhibiting further corrosion caused by magnesium chloride. The solution, measured by weight, includes approximately 40–60% phosphoric acid, 1–6% wetting agent, 0.5–5% inhibitor, and the remaining percentage water.

Although any of a number of different mixtures may be used within these ranges, a preferred embodiment of the present invention includes a mixture of phosphoric acid (about 49% by weight), a nonionic surfactant (about 3% by weight), a cationic surfactant (1% by weight) and the remainder consisting of water.

In a preferred embodiment, the contaminated material may be sprayed with a high-pressure washer to remove excessive buildup and expose the underlying material. Then the solution is applied to the surface by spraying the solution on through a spraying device, using a ratio in the range of 10:1 to 25:1 water to solution. The solution is applied and left on the contaminated surface for approximately 2–5 minutes, and then rinsed off with water. In an alternate embodiment, the solution may be applied as a coating either by rubbing the solution on an affected surface with a cloth or by brushing the solution on the material. It is to be expressly understood that other application techniques may be used as well.

The materials upon which the solution of the present invention may be applied include, but are not limited to aluminum, aluminum alloys, steel, rebar, chrome, plastics, ceramics, rubber, including insulation on electrical wiring, and painted surfaces including those previously mentioned. These materials comprise the majority of the materials used on automobiles and roadside apparatus, including but not limited to signs, rails, and posts. The solution in a preferred embodiment removes magnesium chloride deposits that cause deterioration to these materials, thereby preventing potential catastrophic failure to the vehicle or roadside apparatus material. In a preferred embodiment, the solution includes an inhibiting agent to assist in preventing future corrosion caused by magnesium chloride.

The combination of the removing and inhibiting agents in this solution provides a unique method of combating the corrosive effects of magnesium chloride. With one application of the solution either by spraying or coating the contaminated surface, the magnesium chloride is effectively removed without causing further damage to the material.

This solution may be used in a variety of different locations. It may be applied directly by the vehicle owner or operator prior to travel during the winter months. It may also be applied after travel has been completed but before serious corrosion has begun, as would be the case at a professional truck wash or carwash service location. Highway departments or other state and municipal departments would have a need for this solution in order to protect their own vehicles and roadside apparatus.

This solution also has several other benefits over the prior art. For example, the solution does not require the contaminated surface to be removed from the apparatus it is attached to, and care to avoid exposure to surrounding materials is no longer necessary. Furthermore, after applying a single coat the inhibitor is applied to help prevent bonding of the magnesium chloride compound to the exposed surface.

It is to be expressly understood that the above descriptive embodiment is intended for explanatory purposes only and is not meant to limit the scope of the invention. Other embodiments are certainly within the scope of the claimed invention. For example, while the surfaces discussed are typically in reference to vehicle surfaces, the solution is certainly not limited to those types of surfaces. Any surface that is in the range of materials discussed above may be treated with the solution of the invention.

As will be understood by those familiar with the art, the present invention may be embodied in other specific forms without departing from the spirit or essential characteristics thereof, including but not limited to varying percentages by weiqht, the use of different surfactants and inhibitors, or the use of deionized water.

EXAMPLES

The following example was performed to illustrate the aspects of the solution and it's effectiveness in removing magnesium chloride without damaging the contaminated material.

Example 1

A sample strip of aluminum alloy, similar to the material commonly used in the construction of commercial vehicles, such as tanker trucks, was attached to the lower front portion of a vehicle. The vehicle was driven for a 2-week period during the winter season in an area where magnesium chloride is used to treat snowy roads. At the end of the 2-week period the sample was visibly coated with magnesium chloride deposits throughout the entire piece, which was removed from the vehicle and segmented into several smaller samples of even size. The sample squares were washed with water using a high-pressure sprayer to remove the excessive build-up. The samples were then labeled according to position along the strip, and each sample was exposed to one of four different solutions, as shown in the following table.

TABLE 1

| | | |
|---|---|---|
| Trisodium nitrilotriacetate | 1 ml | removed scale, etching |
| Organic acid salt | 1 ml | failed to remove scale |
| Hydrofluoric acid | 1 ml | removed scale, etching |
| Phosphoric acid solution | 1 ml | removed scale, no etching |

The phosphoric acid solution above is within the range of the solution of the present invention. The above solutions were applied in 1 ml quantities to multiple samples, and left for 3 minutes before rinsing with water. The phosphoric acid solution was the only solution tested which both removed all of the magnesium chloride on the sample, but also left a shiny metallic surface after it was rinsed off. The trisodium nitrilotriacetate left the surface with notable etching that could not be rubbed clean with a cloth. The hydrofluoric acid solution left the surface looking white and would have required further treatment to return the aluminum alloy to its original condition.

The invention is not limited to the example discussed above, but on the contrary is intended to cover the various modifications and equivalent arrangements included without departing from the spirit or essential characteristics of the appended claims.

The invention claimed is:

1. A method for treating magnesium chloride deposits from a material comprising the steps of:

selecting a material contaminated with magnesium chloride; and, applying a solution including a phosphoric acid representing approximately 40–60% of said solution by weight, a wetting agent representing approximately 1–6% of said solution by weight, and an inhibitor representing approximately 0.5–5% of said solution by weight.

2. The method of claim 1 wherein said phosphoric acid consists of about 49% by weight of said solution.

3. The method of claim 1 wherein said wetting agent consists of about 3% by weight of said solution.

4. The method of claim 1 wherein said inhibitor consists of about 1% by weight of said solution.

5. The method of claim 1 wherein said material includes a vehicle surface.

6. The method of claim 1 wherein said material includes a roadside structure surface.

7. The method of claim 1 wherein said material includes wiring components on a vehicle.

8. The method of claim 1 wherein said material includes a building floor surface.

9. The method of claim 1 wherein said treating magnesium chloride deposits includes removing said magnesium chloride deposits.

10. The method of claim 1 wherein said treating magnesium chloride deposits includes inhibiting said magnesium chloride deposits.

11. The method of claim 1 wherein said applying a solution further comprises spraying said solution onto said contaminated material with a low-pressure washing apparatus.

12. The method of claim 1 wherein said applying a solution further comprises coating said contaminated material with said solution and rinsing said solution off said contaminated material after a duration of time.

* * * * *